US010981348B2

(12) United States Patent
Kohler

(10) Patent No.: US 10,981,348 B2
(45) **Date of Patent: *Apr. 20, 2021**

(54) APPARATUS FOR PRODUCING A CORRUGATED PRODUCT

(71) Applicant: INTPRO, LLC, Uniontown, OH (US)

(72) Inventor: Herbert B. Kohler, Uniontown, OH (US)

(73) Assignee: INTPRO, LLC, Uniontown, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/717,776

(22) Filed: Dec. 17, 2019

(65) Prior Publication Data

US 2020/0122426 A1 Apr. 23, 2020

Related U.S. Application Data

(63) Continuation of application No. 16/299,295, filed on Mar. 12, 2019, now Pat. No. 10,603,864.

(60) Provisional application No. 62/658,642, filed on Apr. 17, 2018.

(51) Int. Cl.

| | |
|---|---|
| ***B31F 1/28*** | (2006.01) |
| ***B31F 1/22*** | (2006.01) |
| *B65H 23/24* | (2006.01) |

(52) U.S. Cl.

CPC ..... *B31F 1/2836* (2013.01); *B31F 1/225* (2013.01); *B31F 1/2863* (2013.01); *B31F 1/2877* (2013.01); *B65H 23/24* (2013.01)

(58) Field of Classification Search

CPC ..... B31F 1/32; B31F 1/2863

See application file for complete search history.

(56) References Cited

U.S. PATENT DOCUMENTS

| | | | |
|---|---|---|---|
| 2,544,743 | A | 3/1951 | Richard et al. |
| 3,053,309 | A | 9/1962 | Wilson et al. |
| 3,479,240 | A | 11/1969 | Moser |
| 4,202,719 | A | 5/1980 | Linn |
| 5,383,409 | A | 1/1995 | Hayakawa |
| 5,419,796 | A | 5/1995 | Miller |
| 5,628,865 | A | 5/1997 | Marschke |
| 5,951,816 | A | 9/1999 | Marschke |
| 6,171,427 | B1 | 1/2001 | Hess et al. |

(Continued)

FOREIGN PATENT DOCUMENTS

| | | | |
|---|---|---|---|
| EP | 1329306 | A2 | 7/2003 |
| GB | 808900 | A | 6/1955 |

(Continued)

OTHER PUBLICATIONS

International Search Report & Written Opinion in PCT/US2019/021742 dated Jun. 18, 2019, 13 pages.

*Primary Examiner* — Barbara J Musser
(74) *Attorney, Agent, or Firm* — Pearne & Gordon LLP

(57) ABSTRACT

An apparatus for introducing transverse trapezoidal corrugations into a traveling web is provided, and includes a plurality of corrugating rollers for imparting corrugations to the web. In disclosed embodiments four such rollers are provided in a roller train defining respective first, second and third nips therebetween, wherein the teeth of the first and second rollers have rounded distal faces and those of the third and fourth rollers have flattened distal faces. Methods of yielding a trapezoidal corrugated web also are disclosed.

28 Claims, 6 Drawing Sheets

(56) References Cited

U.S. PATENT DOCUMENTS

| | | | | |
|---|---|---|---|---|
| 6,733,432 | B2 | 5/2004 | Marschke | |
| 8,057,621 | B2 | 11/2011 | Kohler | |
| 8,951,376 | B2 * | 2/2015 | Rasmussen | B32B 3/28 156/205 |
| 2006/0225830 | A1 | 10/2006 | Kohler | |

FOREIGN PATENT DOCUMENTS

| | | | |
|---|---|---|---|
| GB | 2515559 | A | 12/2014 |
| JP | 2000062056 | A | 2/2000 |

* cited by examiner

APPARATUS FOR PRODUCING A CORRUGATED PRODUCT

CROSS-REFERENCE TO RELATED APPLICATIONS

This application is a continuation of U.S. patent application Ser. No. 16/299,295 filed Mar. 12, 2019, now U.S. Pat. No. 10,603,864, which claims the benefit of U.S. provisional patent application Ser. No. 62/658,642 filed Apr. 17, 2018, the contents of which are incorporated herein by reference.

FIELD OF THE INVENTION

This application relates generally to an apparatus for producing a corrugated product, and more particularly to an apparatus for producing a corrugated product with trapezoidal corrugations.

BACKGROUND OF THE INVENTION

Corrugated webs possess increased strength and dimensional stability compared to un-corrugated (i.e. flat) webs of the same material. For example, corrugated paperboard or cardboard is widely used in storage and shipping boxes and other packaging materials to impart strength. A typical corrugated cardboard structure known as 'double-wall' includes a corrugated paperboard web sandwiched between opposing un-corrugated paperboard webs referred to as 'liners.' The opposing liners are adhered to opposite surfaces of the corrugated web to produce a composite corrugated structure, typically by gluing each liner to the adjacent flute crests of the corrugated web. This structure is manufactured initially in planar composite boards, which can then be cut, folded, glued or otherwise formed into a desired configuration to produce a box or other form for packaging.

Corrugated webs such as paperboard are formed in a corrugating machine starting from flat webs. A conventional corrugating machine feeds the flat web through a nip between a pair of corrugating rollers rotating on axes that are perpendicular to the direction of travel of the web when viewed from above. Each of the corrugating rollers has a plurality of longitudinally-extending teeth defining alternating peaks and valleys distributed about the circumference and extending the length of the roller. The rollers are arranged so that their respective teeth interlock at the nip, with the teeth of one roller being received within the valleys of the adjacent roller. The interlocking teeth define a corrugating labyrinth through which the web travels as it traverses the nip. As the web is drawn through the corrugating labyrinth it is forced to conform to the configuration thereof, thus introducing into the web flutes or corrugations that approximate the dimensions of the pathway through the corrugating labyrinth. An example of this conventional methodology is shown in U.S. Pat. No. 8,057,621 (see FIGS. 7 and 7a thereof), which is incorporated herein by reference in its entirety.

Corrugating a web in this manner can introduce a substantial amount of oscillatory frictional and tension forces to the web leading into and while traversing the corrugating nip. Briefly, as the web is drawn between the corrugating rollers and forced to negotiate the corrugating labyrinth, tensile stresses in the web, as well as compressive stresses normal to the plane of the entering web, oscillate in magnitude and direction as successive flutes are formed due to the reciprocating motion of the corrugating teeth relative to the web, and due to roll and draw variations in the web through the labyrinth as it is being corrugated. The resulting cyclic peaks in web stresses can produce structural damage in the web as it is corrugated. Structural damage is particularly likely if sharp edges are present along the teeth of the corrugating rollers.

Therefore, in order to limit stresses in the web during corrugation, the teeth in conventional corrugating rollers are shaped to have a sinusoidal profile such that no sharp edges, nor discrete edges whose radii of curvature approach or approximate a sharp edge, are present along the teeth. Consequently, the final corrugated web will also have a continuous, smooth sinusoidal shape. However, layered structures made with such sinusoidal-corrugated webs can be inferior in quality to layered structures made with webs having other corrugated shapes.

More specifically, a layered cardboard structure in which a web having trapezoidal-shaped corrugations is sandwiched between flat liners can be vastly superior in strength compared to a similar layered cardboard structure having a web with sinusoidal-shaped corrugations. For example, the straight legs of trapezoidal-shaped corrugations extending between the liners can be more resistant to compression than the curved legs of sinusoidal-shaped corrugations. Furthermore, the flat peaks and valleys of trapezoidal-shaped corrugations can provide a greater surface area for adhesion to the opposing liners than the rounded peaks of sinusoidal-shaped corrugations. This greater surface area can provide enhanced adhesion between the corrugated web and outer layers, thereby creating a more rigid structure that is more resistant to tearing, bending, and falling apart.

As desirable as trapezoidal-shaped corrugations for a web may be, such corrugations are difficult to achieve using conventional techniques for corrugating. For example, feeding a flat web to a pair of corrugating rollers having closely interlocking trapezoidal-shaped teeth would impart too much stress to the web due to the discrete edges of the teeth and the dramatic change in shape to the web, thereby damaging the web.

BRIEF SUMMARY OF THE INVENTION

An apparatus for producing a corrugated product is disclosed. It includes a roller train having a first corrugating roller having a first set of corrugating teeth; a second corrugating roller having a second set of corrugating teeth; a third corrugating roller having a third set of corrugating teeth; and a fourth corrugating roller having a fourth set of corrugating teeth. A first nip is defined between the first and second corrugating rollers opposing one another. A second nip is defined between the second and third corrugating rollers opposing one another. A third nip is defined between the third and fourth corrugating rollers opposing one another. Each tooth in each of the first, second, third and fourth sets of teeth has a distal face, a leading flank and a trailing flank. The distal faces of each of the first and second sets of teeth are rounded. The distal faces of each of the third and fourth sets of teeth are flattened.

A method of introducing trapezoidal corrugations to a traveling web also is disclosed, including the steps of: feeding the web through a first nip defined between first and second corrugating rollers having respective first and second sets of teeth that oppose one another in the first nip, the web following a first path through the first nip tangent to respective edges of the opposing teeth therein; thereafter feeding the web through a second nip defined between the second corrugating roller and a third corrugating roller, the third corrugating roller having a third set of teeth that opposes the second set of teeth in the second nip, the web following a second path through the second nip tangent to respective edges of the second set of teeth and discretely folding over respective edges of the third set of teeth therein; and thereafter feeding the web through a third nip defined between the third corrugating roller and a fourth corrugating roller, the fourth corrugating roller having a fourth set of teeth that opposes the third set of teeth in the third nip, the web following a third path through the third nip discretely folding over respective edges of the opposing teeth therein.

DESCRIPTION OF EXAMPLE EMBODIMENTS

Figure 1:
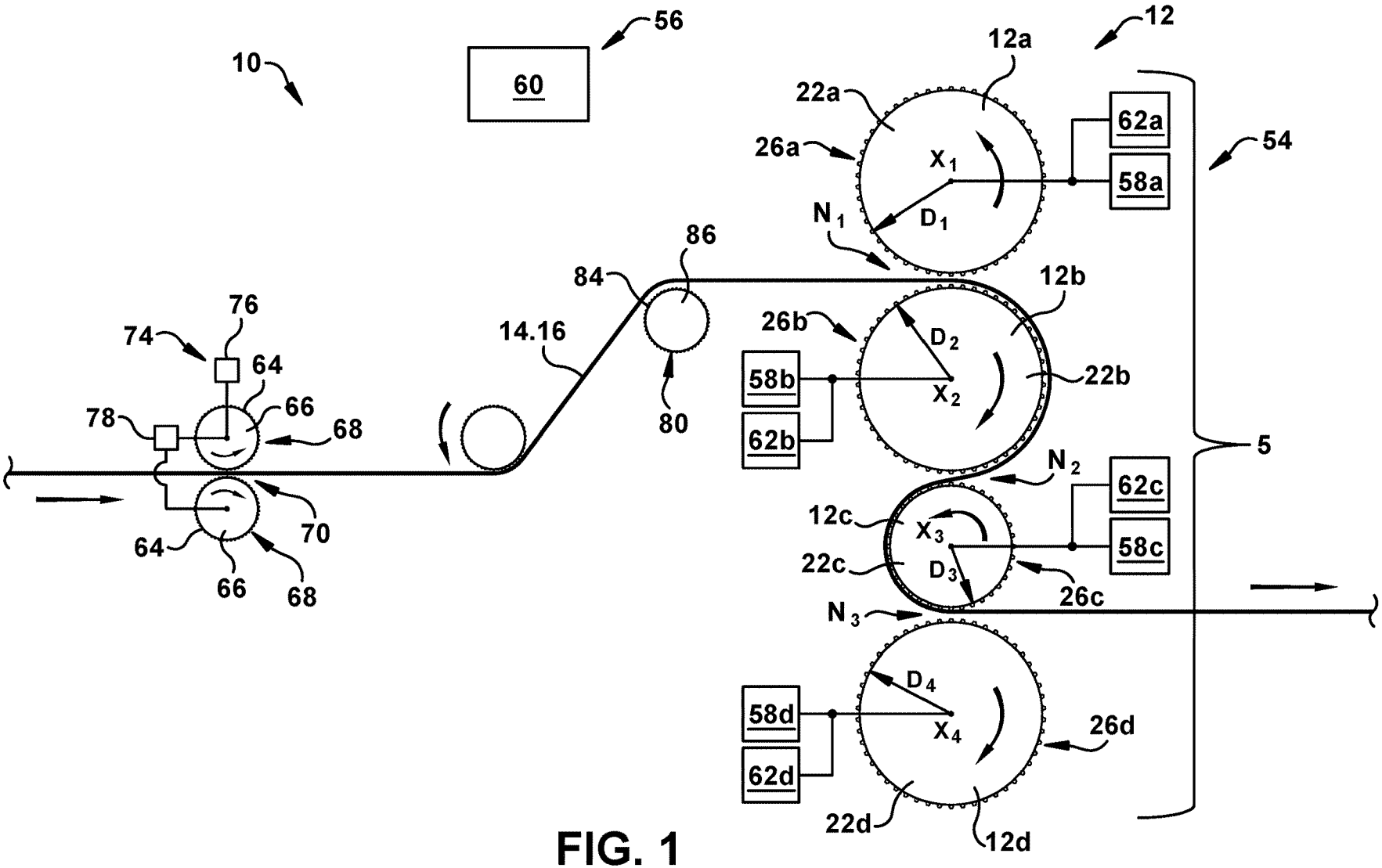
FIG. 1 is a schematic view of an example corrugating apparatus.

The corrugating apparatus will now be described more fully hereinafter with reference to the accompanying drawings in which embodiments of the disclosure are shown. Whenever possible, the same reference numerals are used throughout the drawings to refer to the same or like parts. However, this disclosure may be embodied in many different forms and should not be construed as limited to the embodiments set forth herein.

Turning to FIG. 1, an example corrugating apparatus 10 is schematically illustrated. The apparatus 10 includes a plurality of corrugating rollers 12*a*, 12*b*, 12*c* and 12*d* (hereafter referred to collectively by the reference numeral "12") for imparting corrugations to a web 14 of material as the web 14 follows a web travel pathway 16 in a machine direction. The web 14 of material can be fed from a source of corrugating medium (e.g., from rolls as is conventional in the art, not shown) along the web travel pathway 16 to the corrugating apparatus 10 in a substantially flat condition. Moreover, it is to be appreciated that the web 14 may be fed from the source through other, intermediary stages (e.g., driers, heaters, moisturizers, etc.) prior to entering the corrugating apparatus 10.

The plurality of corrugating rollers 12 includes a series of four rollers organized in a roller train, such that successive pairs of adjacent rollers defines a respective nip therebetween along the web travel pathway. As shown in FIG. 1, the roller train 5 includes a first corrugating roller 12*a*, a second corrugating roller 12*b*, a third corrugating roller 12*c*, and a fourth corrugating roller 12*d*. Each corrugating roller has a respective cylindrical body 22*a*, 22*b*, 22*c* or 22*d* that is rotatable about a longitudinal axis thereof. A plurality of teeth 26*a*, 26*b*, 26*c* or 26*d* protrude radially from and are distributed circumferentially about the body of the respective roller, each such tooth extending the length of the roller in the body's longitudinal direction. In particular, the cylindrical body 22*a* of the first corrugating roller 12*a* has a first diameter $D_1$ and a first longitudinal axis $X_1$, the cylindrical body 22*b* of the second corrugating roller 12*b* has a second diameter $D_2$ and a second longitudinal axis $X_2$, the cylindrical body 22*c* of the third corrugating roller 12*c* has a third diameter $D_3$ and a third longitudinal axis $X_3$, and the cylindrical body 22*d* of the fourth corrugating roller 12*d* has a fourth diameter $D_4$ and a fourth longitudinal axis $X_4$.

The corrugating rollers 12 are arranged such that the teeth 26*a* of the first corrugating roller 12*a* interlace with the teeth 26*b* of the second corrugating roller 12*b*, the teeth 26*b* of the second corrugating roller 12*b* interlace with the teeth 26*c* of the third corrugating roller 12*c*, and the teeth 26*c* of the third corrugating roller 12*c* interlace with the teeth 26*d* of the fourth corrugating roller 12*d*. Accordingly, a first nip $N_1$ is defined between first and second corrugating rollers 12*a*, 12*b* where they interlace, a second nip $N_2$ is defined between second and third corrugating rollers 12*b*, 12*c* where they interlace, and a third nip $N_3$ is defined between third and fourth corrugating rollers 12*c*, 12*d* where they interlace.

In the illustrated embodiment, the corrugating rollers 12 are aligned vertically such that their axes $X_{1-4}$ extend substantially parallel to each other and reside on a common vertical plane. Moreover, the web travel pathway 16 preferably enters the first nip $N_1$ between the first and second corrugating rollers 12*a*, 12*b* along a horizontal path, substantially tangent to the first and second corrugating rollers 12*a*, 12*b* and perpendicular to the aforesaid common vertical plane. The web travel pathway 16 then proceeds 1) through the first nip $N_1$ between the first and second corrugating rollers 12*a*, 12*b*, then 2) circumferentially around a portion (e.g., a 180° arc-segment) of the second corrugating roller 12*b*, then 3) through the second nip $N_2$ between the second and third corrugating rollers 12*b*, 12*c*, then 4) circumferentially around a portion (e.g., a 180° arc-segment) of the third corrugating roller 12*c*, and then 5) through the third nip $N_3$ between the third and fourth corrugating rollers 12*c*, 12*d*. The web travel pathway 16 then exits the third nip $N_3$, again preferably along a horizontal path substantially tangent to the third and fourth corrugating rollers 12*c*, 12*d* and perpendicular to the aforesaid common vertical plane.

However, it is to be appreciated that the corrugating rollers 12 may be aligned in other non-vertical orientations in some embodiments. Moreover, the axes $X_{1-4}$ of the corrugating rollers 12 may be offset from each other such that the one or more of the axes do(es) not reside on a common plane with other axes. Still further, the web travel pathway 16 may enter and/or exit the corrugating rollers 12 in alternative locations and orientations, and the web travel pathway 16 may extend about portions or arc-segments of the corrugating rollers 12 other than as illustrated. Indeed, the corrugating rollers 12 and web travel pathway 16 may be arranged in any configuration in which the corrugating rollers 12 are interlaced as described to define three successive nips therebetween, such that the web travel pathway 16 travels through those nips between the corrugating rollers 12 in the roller train 5.

The corrugating rollers 12 are designed such that the web 14 can be fed along the web travel pathway 16 as the corrugating rollers 12 rotate, through the nips $N_{1-3}$ of the corrugating rollers 12. As the web 14 travels through each nip $N_{1-3}$, the corrugating rollers 12 of the nip $N_{1-3}$ will impart a corrugation pattern to the web 14. In particular, as discussed further below, the respective sets of teeth 26*a-d* of the four corrugating rollers 12*a-d* are designed to have progressive geometries such that the nips $N_{1-3}$ progressively corrugate the web 14 to eventually impart trapezoidal-shaped corrugations in the web 14.

Figure 2:
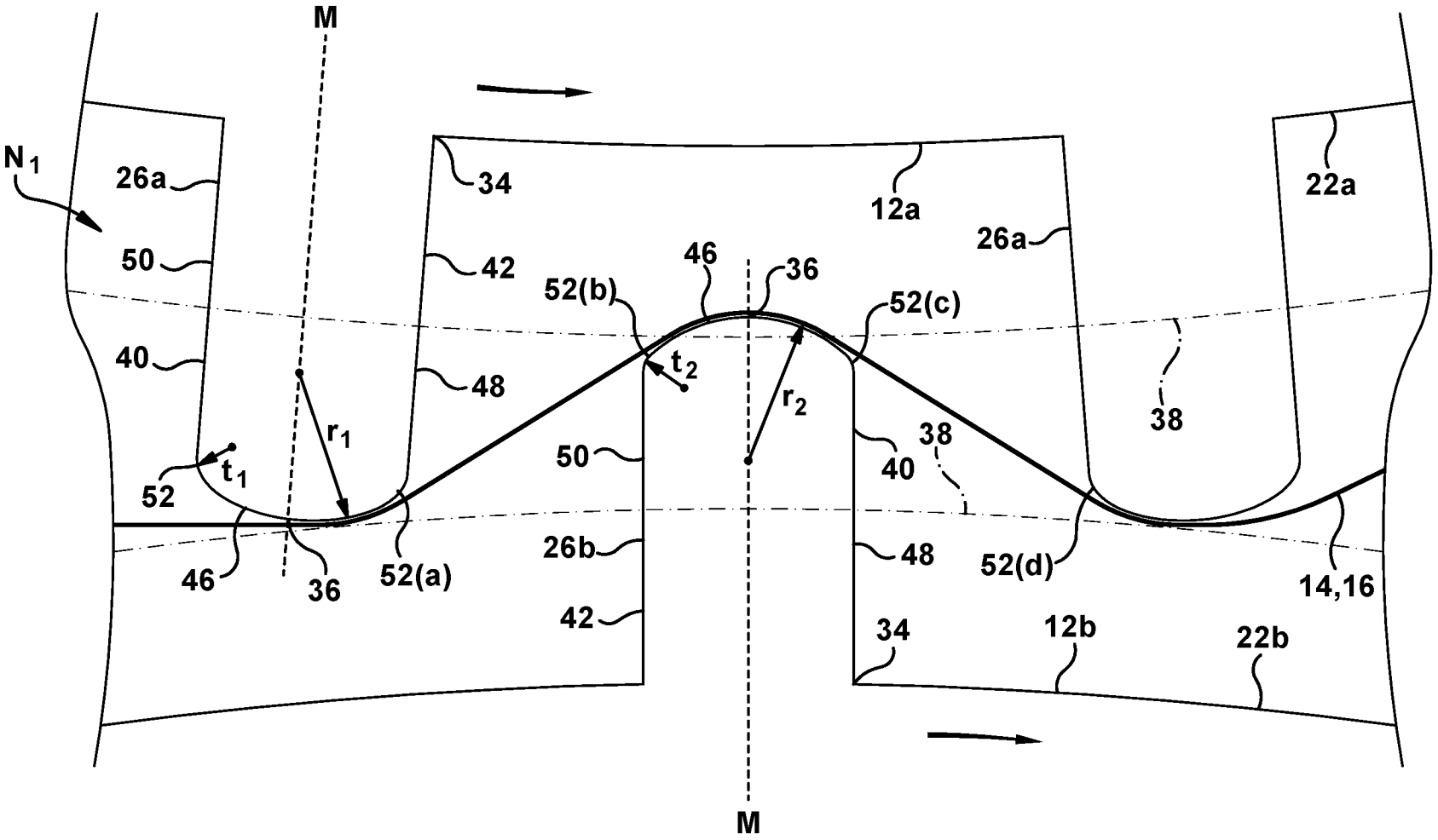
FIG. 2 is an enlarged view of a first nip of the corrugating apparatus.
Figure 3:
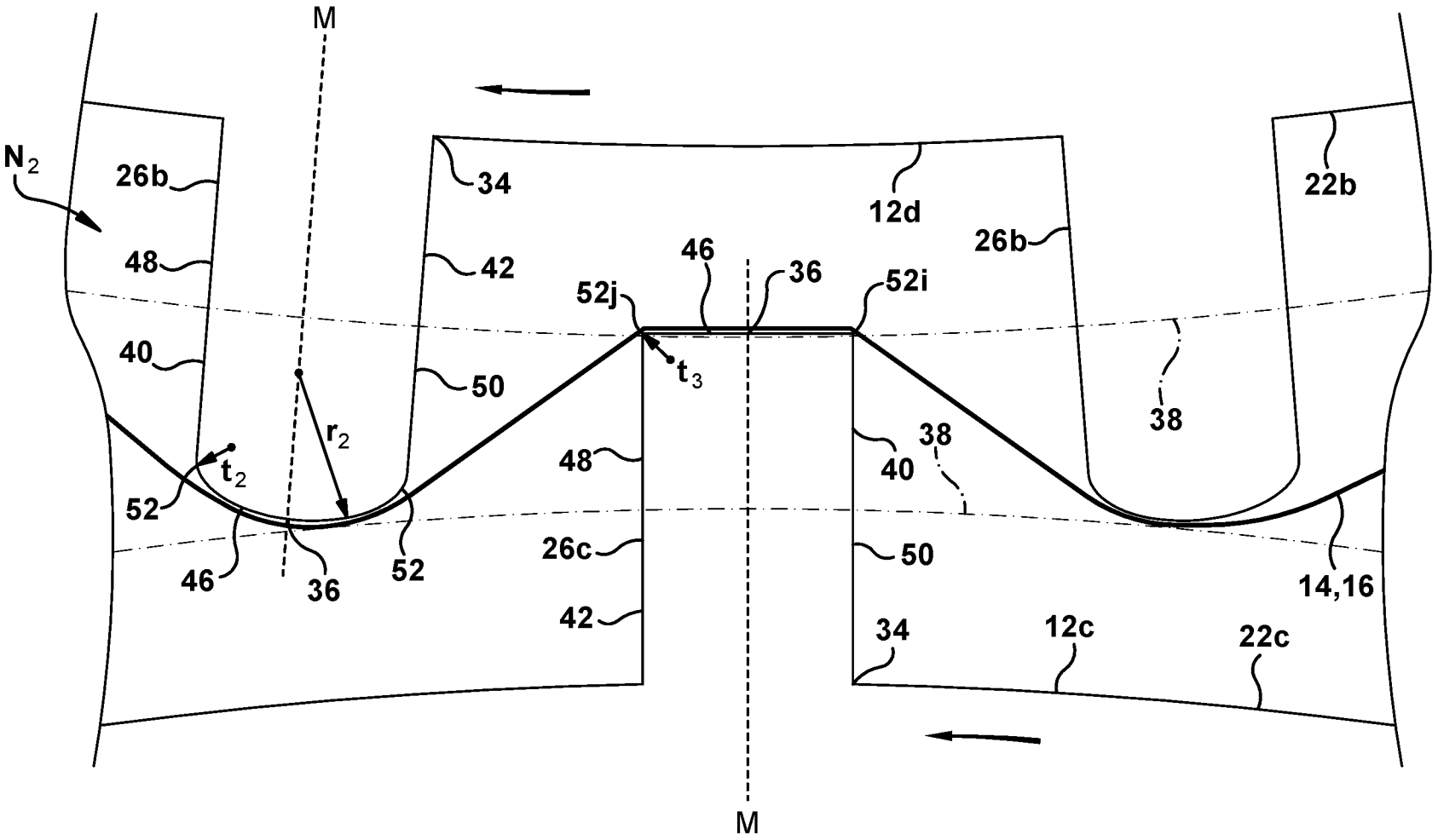
FIG. 3 is an enlarged view of a second nip of the corrugating apparatus.
Figure 4:
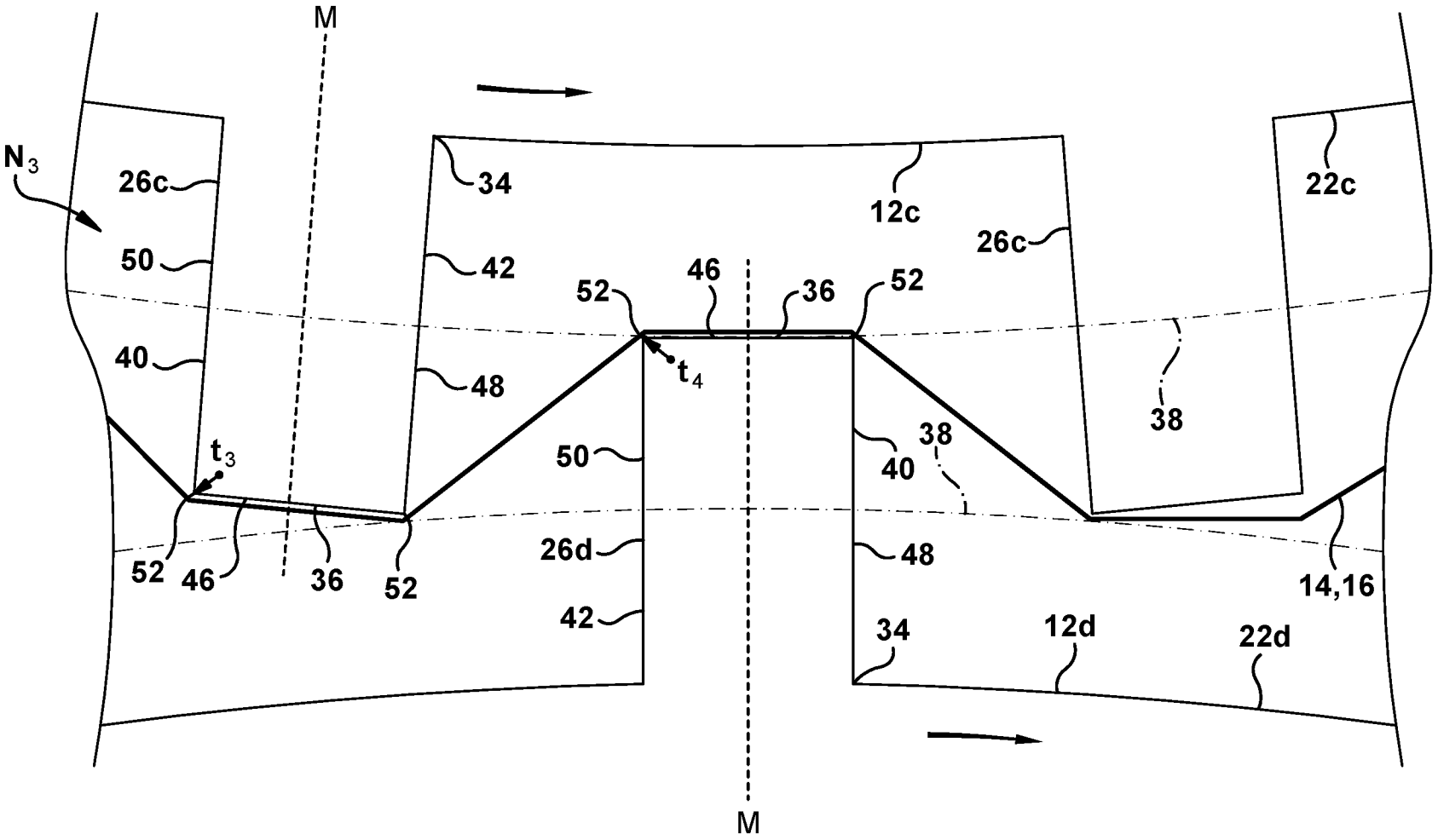
FIG. 4 is an enlarged view of a third nip of the corrugating apparatus.

More specifically, turning to FIGS. 2-4, the teeth 26*a-d* and nips $N_{1-3}$ of the respective corrugating rollers 12*a-d* will now be described in further detail. FIG. 2 shows an example of the first nip $N_1$ between the respective opposing sets of teeth 26*a*, 26*b* of the first and second corrugating rollers 12*a*, 12*b*. FIG. 3 shows an example of the second nip $N_2$ between the respective opposing sets of teeth 26*b*, 26*c* of the second and third corrugating rollers 12*b*, 12*c*. FIG. 4 shows an example of the third nip $N_3$ between the respective opposing sets of teeth 26*c*, 26*d* of the third and fourth corrugating rollers 12*c*, 12*d*.

As can be seen in FIGS. 2-4, each tooth 26 of the corrugating rollers 12 extends radially from its associated cylindrical body 22 beginning at a root 34 adjacent to where the tooth is cantilevered from the body 22, to a distal end 36 of the tooth 26. Each tooth 26 has a leading flank 48 (which first encounters the web 14 traveling through its associated nip in the direction of rotation of the roller 12) and a trailing flank 50 (which is last to encounter the web 14 in the direction of rotation). An distal face 46 extends between the leading and trailing flanks 48, 50 of each tooth 26 at the distal end thereof, remote from the root. Also, each tooth 26 defines a diametral plane M and a pitch circle 38. For the purposes of this disclosure, the "diametral plane" of a tooth is an imaginary plane that extends diametrically through the tooth and through the longitudinal axis of the cylindrical body from which the tooth extends. Moreover, the "pitch circle" of a tooth is an imaginary circle concentric with the roller from which the tooth extends and which intersects the tooth's diametral plane at a midpoint of the tooth located halfway between the tooth's root 34 and its distal end 36 located at the center of the distal face 46 of the tooth. Each tooth 26 includes a radially outer portion 40 that extends from its pitch circle to its distal end 36, and a radially inner portion 42 that extends from its root to its pitch circle. That is, the pitch circle is where each tooth's outer and inner portions 40 and 42 intersect. As will be appreciated, for a roller 12 having commonly sized and shaped teeth 26, all the teeth 26 of that roller 12 will share a common pitch circle, such that their respective outer and inner portions 40 and 42 are substantially equal to one another.

As shown in FIGS. 2-4, the flanks 48, 50 of each tooth 26 intersect with the tooth's distal face 46 at respective edges 52. The angle between the distal face 46 and each flank 48, 50 (measured between the respective flank and an imaginary plane that is perpendicular to the diametral plane and passes through the distal end 36 of the associated tooth 26) can vary amongst corrugating rollers 12. In the illustrated embodiments the aforementioned angle for the teeth 26*a-d* of the respective rollers 12*a-d* is 90°, because all the flanks 48 and 50 thereof extend parallel to the respective diametral planes M. However, flanks 48, 50 that are not parallel to the associated diametral plane M will yield different such angles. Moreover, each such edge 52 (particularly for the teeth 26*a*, 26*b* of the first and second rollers 12*a*, 12*b*) can be a radiused edge having a relatively large radius of curvature, such that the interface between the respective flank 48, 50 and the distal face 46 of the tooth is smooth and continuous, without any sharp or discrete transition. In other embodiments (particularly for the teeth 26*c*, 26*d* of the third and fourth rollers 12*c*, 12*d*), each such edge can be a radiused edge having a relatively small radius of curvature, for example small enough to yield a discernible, discrete interface between the respective flank 48, 50 and the distal face 46 of the tooth. Such a discrete interface may approximate a sharp-edge between the associated flank 48, 50 and distal face 46 of the tooth when viewed from a distance. This is true even though the edge 52 technically is radiused, whose radius of curvature can be selected to avoid damaging a web 14 traversing the associated nip over the tooth.

Moreover, as seen in FIG. 2 the edges 52 (e.g. of teeth 26*a*, 26*b* of the first and second rollers 12*a*, 12*b*) can exhibit a progressive radius of curvature; i.e. a decreasing radius of curvature beginning from the distal face 46 (such as from distal end 36) toward the flanks 48, 50. In this embodiment, the distal face 46 itself is or possesses portions that is/are continuously curved so as to transition seamlessly to the edge(s) 52 of the tooth 26. It is also to be appreciated that in some embodiments, the flanks 48, 50 may form a contoured surface with the distal face 46 such that no clearly defined edge exists between them. For instance, in some embodiments, the teeth 26 of the first corrugating roller 12*a* may have a sinusoidal profile (not shown) such that there is no defined or discernible edge between the flanks 48, 50 and distal face 46 of each tooth. Likewise, the teeth 26 of the second corrugating roller 12*b* may also have a sinusoidal profile in some embodiments. Such a sinusoidal profile is similar to conventional corrugating rollers.

Less preferably, the teeth of the third and fourth rollers may include sharp edges at the interfaces between their respective flanks 48, 50 and the associated distal face 46, the edges 52 having no discernible curvature but instead transitioning discretely, essentially at a line of intersection between one surface (e.g. flank 48 or 50) and the next (e.g. distal face 46). However, such a sharp, technically discrete edge 52 is less preferred, even for the third and fourth sets of teeth 26*c*, 26*d* on the third and fourth corrugating rollers 12*c*, 12*d*, because it may damage or cut the web 14 (e.g. a paper web) that encounters it in, e.g. the second and/or third corrugating nips $N_2$, $N_3$.

With reference now to FIG. 2, in a preferred embodiment the distal face 46 of each tooth 26*a*, 26*b* for the first and second corrugating rollers 12*a*, 12*b* has a rounded shape. In particular, the distal face 46 of each tooth 26*a* for the first corrugating roller 12*a* has a first radius of curvature $r_1$, while the distal face 46 of each tooth 26*b* for the second corrugating roller 12*b* has a second radius of curvature $r_2$. Furthermore, in the illustrated embodiment the flanks 48, 50 of each tooth 26*a*, 26*b* for the first and second corrugating rollers 12*a*, 12*b* can be planar surfaces that extend substantially parallel to the tooth's diametral plane M.

Also shown in FIG. 2, the flanks 48, 50 for each tooth 26*a* of the first corrugating roller 12*a* can intersect with the distal face 46 at respective edges 52 having a first radius of curvature $t_1$. Moreover, the flanks 48, 50 for each tooth 26*b* of the second corrugating roller 12*b* can intersect with the distal face 46 to form respective edges 52 having a second radius of curvature $t_2$. Thus in the illustrated embodiment the rollers 12*a*, 12*b* each have teeth 26*a*, 26*b* whose distal faces 46 transition seamlessly to the associated opposing edges 52, wherein the radius of curvature of the greater distal face 46 is larger than the radius of curvature of the opposing edges 52. Preferably, the radius of curvature $t_1$ for the edges 52 of the first set of teeth 26*a* is selected so that on encountering those edges in the first nip $N_1$, the initially flat web 14 can slide smoothly and continuously over those edges 52, tangent thereto as it is drawn through the nip $N_1$, in order to introduce a smooth, substantially sinus corrugated conformation to the web. Thus the web is gathered lengthwise (i.e. along the machine direction) by introducing sinus corrugations whose machine-direction length and pitch approximate those of final, trapezoidal corrugations to be introduced later. Accordingly, a web 14 traveling along the web-travel pathway 16 through the roller train 5 will emerge from the first nip $N_1$ having a contracted specific length (i.e. superficial or overall web length per unit mass of the web) compared to on entering that nip, such that the ratio of exiting specific length to entering specific length equals the take-up ratio of the web in the final, trapezoidal-corrugated conformation to be introduced therein. In preferred embodiments where the teeth in the first and second sets of teeth 26*a*, 26*b* are the same shape and size, $t_1=t_2$.

The first and second corrugating rollers 12*a*, 12*b* can be rotated in opposite directions (indicated by arrows in FIG. 2) such that that their respective teeth 26*a*, 26*b* traverse the first nip $N_1$ along the web travel pathway 16 in the machine direction. Moreover, the rotation of first and second corrugating rollers 12*a*, 12*b* can be synchronized such that the teeth 26*a*, 26*b* of the first and second corrugating rollers 12*a*, 12*b* will not engage each other when passing through the first nip $N_1$, either by direct contact or indirect (i.e. layered) engagement via the web 14 compressed as a layer therebetween. In particular, as a tooth 26*b* of the second corrugating roller 12*b* (as seen in FIG. 2) passes through the center of the first nip $N_1$, it will be approximately centered between two teeth 26*a* on the first corrugating roller 12*a*, 12*b*, and its distal end 36 will be spaced from the first roller 12*a*. Likewise, the spacing of the respective teeth 26*a*, 26*b* on opposing rollers 12*a*, 12*b* is such that as the rollers 12*a*, 12*b* rotate, the converse will be true for each first tooth 26*a* as it traverses the center of the first nip $N_1$.

Moreover, the first and second corrugating rollers 12*a*, 12*b* can be configured such that as the web 14 travels through the first nip $N_1$, the web 14 will be drawn to wrap around the opposing rounded distal faces 46 of their interlaced teeth 26*a*, 26*b*. Further, with the opposing teeth 26*a*, 26*b* configured and spaced as described above, the web 14 will extend between adjacent interlaced teeth of the first and second corrugating rollers 12*a*, 12*b* such that the web 14 extends tangentially from one distal face 46 (or its adjacent edge 52) to the next on an adjacent, opposing tooth 26*a*, 26*b* on the opposing roller 12*a*, 12*b*. For example, as seen in FIG. 2 as the web 14 traverses the first nip $N_1$, it proceeds tangently from the leading edge 52(*a*) of a first tooth 26*a* extending from the first roller 12*a*, to the trailing edge 52(*b*) of a second tooth 26*b* extending from the second roller 12*b*, over the distal face 46 of that second tooth 26*b* until reaching its leading edge 52(*c*), and then to the trailing edge 52(*d*) of a subsequent first tooth 26*a* extending from the first roller 12*a*. In this manner, contact between the web 14 and the flanks 48, 50 of each tooth 26 within the first nip $N_1$ can be reduced, thereby lowering tension within the web 14 due to friction between the web 14 and the flanks of the teeth 26*a*, 26*b*. That is, the predominant proportion (i.e. at least 50%) of the web length traveling through the first nip $N_1$ does not contact the opposing teeth 26*a*, 26*b* or rollers 12*a*, 12*b*, and instead wraps around only the opposing distal faces 46 of the opposing teeth 26*a*, 26*b* along a path tangent to their respective edges 52. The minimization of web-to-tooth/roller contact through the first nip $N_1$ results at least in part from the fact that the teeth on the opposing rollers 12*a*, 12*b* are interlaced to a limited degree and do not contact one another. That is, at the point of maximum interlacement along the first nip $N_1$ each tooth (e.g. second tooth 26*b* as shown in FIG. 2) is centered and spaced between adjacent teeth on the opposing roller (e.g. the pair of first teeth 26*a* as shown in FIG. 2), extending into the valley defined therebetween but not so far that its distal face 46 contacts any portion of the valley. In this manner, a significant portion of the first nip $N_1$ constitutes empty space through which the web 14 can travel along the web-travel pathway 16 between opposing distal faces 46 of the interlaced teeth 26*a*, 26*b*, without materially contacting other portions of the rollers 12 such as the flanks 48, 50 of the teeth 26*a*, 26*b*. Such spacing is in part because the flanks 48, 50 are truncated from yielding a true sinus pattern along the teeth 26*a*, 26*b* of each roller 12*a*, 12*b*, which allows the teeth 26*a*, 26*b* to interlace and become enmeshed while maintaining spacing between them as the respective rollers 12*a*, 12*b* rotate in a synchronized manner.

As the web 14 exits the first nip $N_1$, the web 14 will consequently have a sinusoidal corrugated configuration even though the teeth 26*a*, 26*b* defining the first nip $N_1$ are not sinusoidal. The now sinus web 14 will have been length-contracted by incorporating sinus corrugations that take up web length in a direction transverse to the machine direction (web travel pathway 16), so that the overall specific length of the web along that direction will have been contracted according to a predetermined take-up ratio. The web 14 will then follow the web travel pathway 16 around the second corrugating roller 12*b* and eventually through the second nip $N_2$, which will now be described in further detail.

With reference to FIG. 3, each tooth 26*c* for the third corrugating roller 12*c* can have a substantially rectangular (e.g. square), trapezoidal or other polygonal shape. In particular, the distal face 46 of each tooth 26*c* for the third corrugating roller 12*c* can be a substantially flat (or flattened relative to the distal faces of the teeth 26*a*, 26*b* of the first and second rollers 26*a*, 26*b*) surface that extends substantially perpendicular to the tooth's diametral plane M. Furthermore, the flanks 48, 50 of each tooth 26*c* for the third corrugating roller 12*c* also can be planar and intersect the distal face 46 at edges 52 having a radius of curvature $t_3$ that is smaller than that of $t_1$ and $t_2$ for teeth on the first and second corrugating rollers 12*a*, 12*b*, respectively. In the illustrated embodiment, the radius of curvature $t_3$ for teeth on the third corrugating roller 12*c* is small enough to approximate a sharp, discrete edge 52 even though the edges of teeth 26*c* technically are radiused. The radius $t_3$ is small enough so as to introduce a discrete fold or crease into the traveling web 14 as it encounters and is drawn over the edge 52 of a tooth 26*c* in the second nip $N_2$. In particular, the radius $t_3$ preferably is not more than 0.5 times either radius $t_1$ or $t_2$, or not more than 0.4, 0.3, 0.2 or 0.1 times either radius $t_1$ or $t_2$.

As will be appreciated in FIG. 2, the leading edge 52*i* of a third tooth 26*c* that first encounters the web 14 in the second nip $N_2$ will engage that web at a shoulder of an initially sinus corrugation, and the trailing edge 52*j* of that tooth 26*c* will engage the web 14 at the opposite shoulder of the same initially sinus corrugation. At the same time, the portion of the web 14 between those two shoulders (i.e. between the points of contact with edges 52*i* and 52*j*) is flattened against the distal face 46 of the tooth 26*c* via tension in the web, whereupon the edges 52*i*, 52*j* impart discrete creases or folds into the web, culminating in the formation of a trapezoidal corrugation from the originally sinus corrugation that first encountered the tooth 26*c*. That tooth then carries the newly formed trapezoidal corrugation of the web 14 until exiting the nip $N_2$ upon which, as will be appreciated, every second corrugation (i.e. all those facing a first direction) will be trapezoidal, and the interposed alternate corrugations will remain sinus.

One will appreciate that in transforming every other sinus corrugation to a trapezoidal corrugation through the second nip $N_2$, the web 14 is not dragged over the low-radius ($t_3$) edges 52 of the third set of teeth 26*c*. Rather, because the web had already been formed into a sinus conformation, whose sinus corrugations approximate the pitch and shape of the trapezoidal corrugations to be introduced by the third set of teeth 26*c*, engagement with the edges (e.g. edges 52*i*, 52*j*)

of those teeth 26*c* does not consume web length because the take-up ratio (and specific length) of the web through the second nip $N_2$ is substantially the same as through the first nip $N_1$. The edges 52 of the third set of teeth 26*c* engage the web at respective shoulders of the entering sinus corrugations and impart creases thereto as they carry the web through the second nip $N_2$. But because this creasing action does not take up additional web length, the web 14 is not dragged over the edges 52 of the third set of teeth 26*c*. That is, the web 14 will have been already gathered and conformed to the corrugated pitch and approximate shape of the final trapezoidal corrugations before it encounters the low-radius ($t_3$) edges 52 of the third set of teeth 26*c*, which also conform to that pitch. Because those edges merely engage and crease the web and do not materially drag or abrade against it, conversion from sinus to trapezoidal corrugations does not introduce material additional sheer or other stresses into the web, which may tend to damage or tear it.

Also as shown, the flanks 48, 50 can extend substantially parallel to the tooth's diametral plane M, and thus perpendicular to the distal face 46. In a further alternative, the flanks 48, 50 of the third roller 12*c* may be planar and extend at a non-normal angle relative to the distal face 46, thus defining trapezoidal-shaped teeth 26. In such an embodiment, however, preferably the slope of the flanks 48, 50 is such that the opposing teeth 26*b* and 26*c* of the second and third rollers 12*b* and 12*c* still will not come into contact within the second nip $N_2$, thus maintaining spacing in the machine direction between adjacent, opposing teeth 26*b*, 26*c*.

The third corrugating roller 12*c* can be rotated in an opposite direction to the second corrugating roller 12*b* (indicated by arrows in FIG. 3) such that that the teeth 26*c* of the third corrugating roller 12*c* interlace with the teeth 26*b* of the second corrugating roller 12*b* with both sets of teeth 26*b*, 26*c* traversing the second nip $N_2$ along the web travel pathway 16 in the machine direction. Moreover, the third corrugating roller 12*c* can be rotated in synchronization with the second corrugating roller 12*b* such that the teeth 26*b*, 26*c* of the second and third corrugating rollers 12*b*, 12*c* will not engage each other when passing through the second nip $N_2$, either by direct contact or indirect engagement via the web 14 therebetween, similar as described above with respect to the first nip $N_1$. In particular, as a tooth 26*b*, 26*c* of one of the second and third corrugating rollers 12*b*, 12*c* passes through the center of the second nip $N_2$, it will be approximately centered between two opposing teeth 26 on the other of the second and third corrugating rollers 12*b*, 12*c*, again similarly as described above.

Moreover, the second and third corrugating rollers 12*b*, 12*c* can be configured such that as the web 14 travels through the second nip $N_2$, the web 14 will be drawn flat and extend over the flat distal faces 46 of the third corrugating roller's interlaced teeth 26*c* as noted above, and wrap around the rounded distal faces 46 of the second corrugating roller's interlaced teeth 26*b* within the second nip $N_2$. Further, the web 14 will extend between its points of contact with the adjacent interlaced teeth 26*b*, 26*c* of the second and third corrugating rollers 12*b*, 12*c* along linear paths such that as the web 14 is drawn through the second nip $N_2$ it extends tangentially from the rounded distal face 46 (or edge 52) of a tooth 26*b* of the second roller 12*b*, to the reduced-radius edge 52 defining a discrete interface between the leading flank and distal face 46 of a tooth 26*c* on the third corrugating roller 12*c* downstream in the second nip $N_2$. Again, contact between the web 14 and the flanks 48, 50 of each tooth 26*b*, 26*c* within the second nip $N_2$ is minimized, and in the illustrated embodiment largely avoided, thereby lowering tension within the web 14 due to friction between the web 14 and portions of the corrugating rollers 12*b*, 12*c* or their respective teeth 26*b*, 26*c* other than their distal faces 46 and associated edges 52.

As the web 14 exits the second nip $N_2$, the web 14 will have upper flutes that are substantially trapezoidal whose crests are in the form of substantially flat lands, and lower flutes whose crests are rounded. The web 14 will then follow the web travel pathway 16 around the third corrugating roller 12*c* and eventually through the third nip $N_3$, which will now be described in further detail.

With reference to FIG. 4, each tooth 26*d* for the fourth corrugating roller 12*d* can have a substantially rectangular (e.g., square) or trapezoidal shape, similar to the third corrugating roller 12*c*. In particular, the distal face 46 of each tooth 26*d* for the fourth corrugating roller 12*d* can be substantially flat (or flattened relative to the distal faces of the teeth 26*a*, 26*b* of the first and second rollers 26*a*, 26*b*) and perpendicular to the tooth's diametral plane M as described above for the third corrugating roller 12*c*. Furthermore, its flanks 48, 50 also can be planar as described above, and either parallel or sloped at an angle relative to the diametral plane M of the tooth 26*d*. Other tooth configurations similar to as described for the third roller 12*c* also are contemplated. Note that the flanks 48, 50 for each tooth 26*d* of the fourth corrugating roller 12*d* can intersect with the tooth's distal face 46 to form respective edges 52 having a fourth radius of curvature $t_4$, which is a reduced radius of curvature compared to both $t_1$ and $t_2$, resulting in discrete transitions between the associated flank 48, 50 and distal face 46 of a tooth 26*d*. As in the third set of teeth 26*c*, the edges 52 of the fourth set of teeth 26*d* also preferably represent sufficiently discrete transitions as to approximate a sharp edge when viewed from a distance, capable to impart a crease to the web 14 on encountering said edges. Also preferably, the radius of curvature $t_4$ is not more than 0.5 times either of $t_1$ and $t_2$, for example not more than 0.4, 0.3, 0.2 or 0.1 either of $t_1$ and $t_2$. In preferred embodiments, $t_4=t_3$, which will yield uniform corrugations at both sides of the web 14 on exiting the third nip $N_3$, assuming the third and fourth sets of teeth 26*c*, 26*d* (or at least their respective distal faces 46) are otherwise of similar shape, size and pitch.

The fourth corrugating roller 12*d* can be rotated in an opposite direction to the third corrugating roller 12*c* (indicated by arrows in FIG. 4) such that that the teeth 26*d* of the fourth corrugating roller 12*d* interlace with the teeth 26*c* of the third corrugating roller 12*c* with both sets of teeth traversing the third nip $N_3$ along the web travel pathway 16 in the machine direction. Moreover, the fourth corrugating roller 12*d* can be rotated in synchronization with the third corrugating roller 12*c* such that the teeth 26*c*, 26*d* of the third and fourth corrugating rollers 12*c*, 12*d* will not engage each other when passing through the third nip $N_3$, either by direct contact or indirect engagement via the web 14 therebetween, similar as has already been described. In particular, as a tooth 26*c*, 26*d* of one of the third and fourth corrugating rollers 12*c*, 12*d* passes through the center of the third nip $N_3$, it will be approximately centered between two opposing teeth 26 on the other of the third and fourth corrugating rollers 12*c*, 12*d*, again as described above.

Moreover, the third and fourth corrugating rollers 12*c*, 12*d* can be configured such that as the web 14 travels through the third nip $N_3$, the web 14 will be drawn flat and extend over the flat distal faces 46 of the fourth roller's teeth 26*d*, similar to the third roller's teeth 26*c* over which it will have already been drawn flat through the second nip $N_2$.

Also similarly as above with respect of the third roller 12*c*, initially sinus corrugations of the web 14 will encounter and be creased by the reduced-radius ($t_4$) edges 52 of the fourth set of teeth 26*d* while tension it the web flattens the segment thereof between the points of contact with opposing edges 52 of the respective fourth set of teeth 26*d*. Still further as above, because the entering sinus corrugations approximate the eventual trapezoidal corrugations to be imparted by the fourth set of teeth 26*d*, their edges 52 do not drag or abrade against the web 14 as they crease it because imparting such creases and the resulting trapezoidal corrugations does not require consumption of additional web length. Rather, the take-up ratio (as well as the specific length) through the third nip $N_3$ is the same as that on exiting both the first and second nips $N_1$ and $N_2$.

On exiting the third nip $N_3$ the web will have a substantially fully trapezoidal corrugated conformation for its flutes extending from both sides of the web. Further, in the third nip $N_3$ the web 14 will extend between its points of contact with the adjacent, interlaced teeth 26*c*, 26*d* of the third and fourth corrugating rollers 12*c*, 12*d* along linear paths such that as the web 14 is drawn through the third nip $N_3$ it extends linearly from the edge 52 of a tooth 26*c* of the third corrugating roller 12*c* to the edge 52 of a tooth 26*d* on the fourth corrugating roller 12*d* downstream in the third nip $N_3$. Here again, contact between the web 14 and the flanks 48, 50 of each tooth 26*c*, 26*d* within the third nip $N_3$ is minimized, and again largely avoided (except with respect of the distal faces 46 of the teeth) in the illustrated embodiment thereby lowering tension within the web 14 by reducing friction. Indeed, although the web is carried over and potentially against the distal faces 46 of the teeth 26*c* and 26*d*, there is little to no relative movement between the web and those faces 46 (or the adjacent edges 52) as the web 14 traverses the nip $N_3$. Rather, those distal faces 46 carry the web 14 as it moves; they do not materially slide against it. And because the web travels between adjacent teeth 26*c*, 26*d* in the nip $N_3$ through open space and not against the shanks 48, 50 of any of the teeth 26*c*, 26*d*, the abrasive friction between tooth shanks and the traveling web that is characteristic of conventional corrugating operations (where opposing tooth sets of the corrugating rollers directly contact and complementarily interlock against one another) is avoided. The same is true of the first and second nips $N_1$ and $N_2$ discussed above, where again the predominant proportion of the web 14 traveling therethrough travels in open space, and not against the shanks 48, 50 of successive teeth 26 through the respective nips. The corrugating rollers 12 as described above can thus produce a web 14 with trapezoidal-shaped corrugations, by progressively corrugating the web 14 via the first, second, and third nips $N_{1\text{-}3}$. In particular, the first nip $N_1$ will corrugate the web 14 to have sinusoidal corrugations, the second nip $N_2$ will corrugate the web 14 to have upper flutes with flat-land crests and lower flutes with rounded crests, and the third nip $N_3$ will corrugate the web 14 to have upper and lower flutes both having flat-land crests such that the overall corrugation conformation is trapezoidal in shape. By progressively corrugating the web 14 in this manner, less stress can be introduced to the web 14 compared to techniques wherein, for example, a flat web is fed directly to a pair of corrugating rollers having square- or trapezoidal-shaped teeth with sharp-edged transitions between their flanks and crests. The disclosed corrugating roller train 5 can impart a double-sided trapezoidal corrugated conformation to an initially flat web (on entering the train 5), without introducing material sheer or stresses into the web 14 beyond that conventionally found in traditional, conventional sinus corrugating.

Moreover, by dimensioning and shaping the teeth 26*a-d* as described above to ensure that opposing teeth within a nip are spaced from one another and do not come into contact, additional space is created for the web 14 to travel between its points of contact on adjacent teeth 26*a-d* without engaging any part of the rollers 12 within that expanse, thereby minimizing friction and the associated web tension that such friction would induce. As a result, even less friction and sheer stresses can be introduced. Moreover, when the web does have to contact a reduced-radius ($t_3$ or $t_4$) edge 52 in order to make the transition (i.e. to discretely fold or crease over the edge 52 of either a third or fourth tooth 26*c*, 26*d*) from rounded crest to flat land, the web can have additional tension capacity to accommodate the tension introduced via contact with the reduced-radius edge 52.

Preferably, the corrugating apparatus 10 is configured to produce a symmetrically-corrugated web 14 having upper and lower trapezoidal-shaped corrugations that are substantially similar to each other in shape.

To achieve this, the flat distal faces 46 on the third and fourth corrugating rollers 12*c*, 12*d* can be substantially similar in machine-direction length, with their respective sets of teeth 26*c*, 26*d* being equally circumferentially spaced about the respective cylindrical bodies 22*c*, 22*d*. Additionally, the rounded distal faces 46 of the teeth 26*a*, 26*b* on the first and second corrugating rollers 12*a*, 12*b* can have substantially similar radii of curvature, and should extend between their respective edges 52 a distance that approximates the machine-direction length of the flat distal faces 46 on the third and fourth rollers 12*c*, 12*d*. Preferably, the outer portions 40 of the teeth 26*c*, 26*d* of third and fourth corrugating rollers 12*c*, 12*d* as a whole will be substantially similar in shape and circumferentially spacing. Moreover, the outer portions 40 the teeth 26*a*, 26*b* of the first and second corrugating rollers 12*a*, 12*b* as a whole can be substantially similar in shape and circumferential spacing. More preferably, the teeth 26*c*, 26*d* as a whole of the third and fourth corrugating rollers 12*c*, 12*d* will be substantially similar in shape and circumferential spacing (as shown in the illustrated embodiment). Also preferably, the teeth 26*a*, 26*b* as a whole of the first and second corrugating rollers 12*a*, 12*b* also will be substantially similar in shape and circumferential spacing (as further shown in the illustrated embodiment).

In this manner, at the points along the web 14 where it will first encounter a reduced-radius ($t_3$, $t_4$) edge 52 to introduce flat lands therein, it will have already been corrugated such that the point of engagement on the web 14 (with the reduced-radius edge 52) will be a shoulder of a pre-existing sinus corrugation in the web 14 that is pre-curved or pre-stressed and which already approximates the trapezoidal configuration that is to be introduced by the reduced-radius edges 52. Therefore, as each such edge 52 introduces a discrete bend or fold to the web 14 in order to form a land therein, it will introduce less stress into the web 14 as compared to if that edge 52 were to introduce such a discrete fold beginning from a generally flat, un-corrugated web.

In an alternative and less preferred embodiment the edges 52 of the third and fourth corrugating rollers 12*c*, 12*d* (see e.g., FIG. 3) can have sharp, un-radiused edges that define essentially linear intersections between the adjacent surfaces (flanks 48, 50 and distal face 46) of the third and fourth sets of teeth 26*c*, 26*d*. Such embodiments may be suitable for very low-caliber papers (for example) that are less likely to be damaged by a sharp-edge transition when used to introduce a crease to the web. But generally, sharp (linear) edge transitions will be less preferred. The radius of curvature $t_3$ for the edges 52 of teeth 26*c* of the third corrugating roller 12*c* and the radius of curvature $t_4$ for the edges 52 of teeth 26*d* of the fourth corrugating roller 12*d* can be functions of the caliper of the paper being processed, and preferably will be greater than 0.1 mm but less than 1.5 mm. Such small-radius edges 52 will be effective to introduce a substantially trapezoidal-corrugated configuration for most webs, via discrete creases in the web that will approximate sharp bends or folds therein. In either embodiment, the progressive nature of the corrugating apparatus 10 described above can enable the edges 52 of the teeth 26*c*, 26*d* on the third and fourth corrugating rollers 12*c*, 12*d* to be sharp with no radius of curvature or of relatively low radius of curvature as above described, without destroying the web 14.

The edges 52 of the teeth 26*a*, 26*b* on the first and second corrugating rollers 12*a*, 12*b* (see e.g., FIG. 1), on the other hand, preferably are radiused and have relatively larger radii of curvature as also described above, to reduce stress on the web 14 between the first and second nips $N_1$, $N_2$. In other words, the radii of curvature $t_1$, $t_2$ for the edges 52 of the teeth 26*a*, 26*b* on the first and second corrugating rollers 12*a*, 12*b* should be finite and greater than the radii of curvature $t_3$, $t_4$. In particular, the radii of curvature $t_1$, $t_2$ preferably are at least 2, for example 3 or 4, times larger than the radii $t_3$ and $t_4$ if the latter define a finite radius of curvature (i.e. if associated with a radiused, as opposed to sharp, edge).

As noted above, the cylindrical bodies 22*a-d* of the corrugating rollers 12*a-d* have respective diameters $D_{1-4}$ (see e.g., FIG. 1). These diameters $D_{1-4}$ may be substantially equal to each other or different from one another. Moreover, each diameter can vary in size amongst embodiments. However, a pair of interlaced rollers 12 with larger diameters can create more stress along the web 14 than a comparable pair of interlaced rollers 12 wherein one or both of the rollers 12 has a smaller diameter. More specifically, a pair of interlaced rollers 12 with larger diameters will have a greater number of interlaced teeth 26 at their nip than if one or both of the rollers 12 had a smaller diameter. Consequently, a corrugating nip defined by opposing, relatively large rollers with large diameters typically would exert more stress in the web 14 than would a comparable nip defined by smaller rollers, because the web must traverse a greater number of opposing teeth simultaneously through the nip.

Accordingly, it can be desirable to provide each corrugating roller 12 with a relatively small diameter. However, rollers 12 with smaller diameters will have less mass and therefore may be more susceptible to vibration or harmonics in operation, which can impair the corrugating process and possibly damage the web 14 via introduction of additional vibratory stresses.

Thus, in some embodiments, one of the second and third corrugating rollers 12*b*, 12*c* can have a smaller diameter compared to the other rollers in the train. For instance, in the illustrated embodiment the diameters $D_1$, $D_2$, $D_4$ of the first, second, and fourth corrugating rollers 12*a,b,d* are relatively large and substantially equal to each other, while the diameter $D_3$ of the third corrugating roller 12*c* is smaller than for the other rollers. In this manner, the number of interlaced teeth in the second and third nips $N_2$, $N_3$ can be reduced, thereby reducing stress along the web 14 within the nips $N_2$, $N_3$. This can be particularly important because it is within these nips that flat lands are introduced to the web 14 by introducing discrete creases therein, which will tend to introduce additional tension. It is believed that by reducing the number of interlaced teeth 26 and therefore the number of contact points at these locations, the web 14 may be better able to withstand the tension introduced when introducing the flat lands. Moreover, vibration and harmonic disturbances in the third corrugating roller 12*c* can still be relatively low based on the fact that its rotation is synchronized with opposing rollers with larger diameters and thereby larger masses. More specifically, a transmission structure synchronizing the rotation of the third roller 12*c* with the larger, higher-massed rollers 12*b* and 12*d* around it, should dampen vibration or harmonics to which the smaller roller 12*c* otherwise might be susceptible when operating at speed.

In other embodiments, the second corrugating roller 12*b* may have the smaller diameter of the four corrugating rollers 12. Moreover, in some examples, the diameters of the larger rollers 12 may not be substantially equal to each other but rather may be different from each other. Indeed, the corrugating rollers 12 may be sized in a variety of different manners wherein a corrugating roller 12 with a smaller diameter is arranged between two corrugating rollers having larger diameters.

As discussed above, the rotation of the corrugating rollers 12 can be synchronized such that the teeth 26 of the corrugating rollers 12 will not engage each other when passing through the nips $N_{1-3}$. In some examples, the corrugating apparatus 10 can include one or more mechanisms that are configured to enable such synchronized rotation of the corrugating rollers 12. For instance, in some examples, two or more (e.g., all) of the corrugating rollers 12 can be coupled together via a transmission such that rotation of one corrugating roller 12 causes synchronized rotation of the other corrugating rollers 12 coupled via the transmission.

In addition or alternatively, as shown in FIG. 1, the corrugating apparatus 10 can include a drive system 54 that is coupled to two or more of the corrugating rollers 12 and operable to rotate the two or more corrugating rollers 12 individually. Moreover, the corrugating apparatus 10 can further include a control system 56 that is operatively coupled to the drive system 54 and configured to operate the drive system 54 based on feedback control to drive the two or more corrugating rollers 12 individually such that the teeth 26 of the two or more corrugating rollers 12 do not engage each other.

For the purposes of this disclosure, "individual" rotation of two or more corrugating rollers 12 means that each corrugating roller 12 will be separately rotated via a separate drive mechanism (e.g., motor), without any mechanical transmission that operatively couples the two or more corrugating rollers 12 to each other such that rotation of one corrugating roller 12 causes rotation of another corrugating roller 12 via the mechanical transmission. It is to be appreciated that such individualized rotation of a corrugating roller 12 may nonetheless be implemented and controlled in a manner such that rotation of the corrugating roller 12 is dependent on and simultaneous with the rotation of other corrugating rollers 12, as discussed further below.

In the illustrated embodiment, the drive system 54 includes a first motor 58*a* that is coupled to the first corrugating roller 12*a* and operable to rotate the first corrugating roller 12*a* individually, a second motor 58*b* that is coupled to the second corrugating roller 12*b* and operable to rotate the second corrugating roller 12*b* individually, a third motor 58*c* that is coupled to the third corrugating roller 12*c* and operable to rotate the third corrugating roller 12*c* individually, and a fourth motor 58*d* that is coupled to the fourth corrugating roller 12*d* and operable to rotate the fourth corrugating roller 12*d* individually. Each motor 58*a-d* can be, for example, an electric motor with variable speed. Moreover, each motor 58*a-d* can be directly coupled to a shaft of its associated corrugating roller 12*a-d* or can be indirectly coupled via a transmission.

Further in the illustrated embodiment, the control system 56 includes a controller 60 (e.g., a programmable logic controller) that is coupled to each motor 58 of the drive system 54 and configured to operate each motor 58 individually. The control system 56 further includes two or more sensors 62 coupled to the controller 60, each configured to provide feedback to the controller 60 for an associated corrugating roller 12. In particular, the control system 56 includes a first sensor 62*a* that is configured to provide feedback control for the first corrugating roller 12*a*, a second sensor 62*b* that is configured to provide feedback control for the second corrugating roller 12*b*, a third sensor 62*c* that is configured to provide feedback control for the third corrugating roller 12*c*, and a fourth sensor 62*d* that is configured to provide feedback control for the fourth corrugating roller 12*d*.

Each sensor 62*a-d* can be configured to detect a parameter of its associated corrugating roller 12*a-d* and send a corresponding signal to the controller 60 that is indicative of the detected parameter. The detected parameter may be, for example, a speed or rotary position of the respective corrugating roller 12*a-d*. For instance, in the illustrated embodiment, each sensor 62*a-d* corresponds to a rotary encoder that is configured to detect a rotary position of its associated corrugating roller 12*a-d* and send a signal to the controller 60 indicative of the detected position.

Based on the signal(s) received from the sensor(s) 62*a-d*, the controller 60 can be configured to operate the corrugating rollers 12*a-d* individually and simultaneously via their associated motors 58*a-d* to rotate at an appropriate speed such that opposing ones of the teeth 26*a-d* of the corrugating rollers 12*a-d* will not engage each other when passing through the nips $N_{1-3}$. By individually operating the corrugating rollers 12*a-d* based on feedback control, the rotation of each corrugating roller 12*a-d* can be precisely controlled to ensure that the teeth 26*a-d* of the corrugating rollers 12*a-d* will not engage each other when passing through the respective nips $N_{1-3}$.

The rotational speed and tooth configuration of the corrugating rollers 12*a-d* will dictate the linear speed of the web 14 through the nips $N_{1-3}$. In particular, it is noted that the linear speed of the web 14 exiting the first nip $N_1$ will be lower than the linear speed of the web 14 entering the first nip $N_1$. This is because as corrugations are formed in a given portion of the web 14 by the first nip $N_1$, the overall machine-direction length of a given portion of the web along the web travel pathway 16 will decrease, because web length will be taken up by newly introduced hills and valleys—meaning that the exiting web (from the first nip $N_1$) will travel more slowly than on entering to move the same segment of web material. Accordingly, the ratio between incoming and exiting speeds of the web 14 will be equal to the ratio between the flat length and the associated corrugated length in the machine direction (i.e., its take-up ratio) for a given segment of the traveling web. The take-up ratio will be determined by the frequency and amplitude of the corrugations imparted in the web 14 by the teeth 26*a, b* of the first and second corrugating rollers 12*a*, 12*b*.

A similar effect on linear speed of the web 14 may occur at the second and third nips $N_2$, $N_3$, if those nips similarly alter the effective machine-direction length of the corrugated web 14. However, it is possible that either or both of the second and third nips $N_2$, $N_3$ may have little or no effect on the linear speed of the web 14 if they simply re-shape its corrugations without substantially altering the length of the web 14.

Ideally, the web 14 will be forcibly fed to the first nip $N_1$ of the corrugating apparatus 10 at the exact speed demanded by the first and second corrugating rollers 12*a*, 12*b*, so that the web 14 has a mean tension of zero on entrance into the first nip $N_1$. However, some finite, non-zero tension is typically desirable in the web 14 on entrance into the first nip $N_1$ to prevent slacking of the web 14 on entry.

Accordingly, in some examples, the corrugating apparatus 10 can include a pair of feed rollers 64 (see e.g., FIG. 1) located upstream of the first nip $N_1$ along the web travel pathway 16. The feed rollers 64 can be rotated to feed the web 14 to the first nip $N_1$ at a given speed. Each feed roller 64 has a cylindrical body 66 with a smooth, outer surface 68 and is rotatable about a longitudinal axis of the cylindrical body 66. The feed rollers 64 define a feed nip 70 therebetween such that the web travel pathway 16 extends through the feed nip 70. The spacing between the feed rollers 64 is predetermined and is slightly smaller than the thickness of the web 14. In this manner, the feed rollers 64 will compress the web 14 therebetween and can be rotated in opposite directions (indicated by arrows in FIG. 1) to feed the web 14 through the feed nip 70 and toward the first nip $N_1$ of the corrugating rollers 12 at a desired speed.

The corrugating apparatus 10 can further include a drive system 74 that is operable to rotate the feed rollers 64 to feed the web 14 toward the first nip $N_1$ of the corrugating rollers 12*a*, 12*b* in a desired manner. Moreover, the drive system 74 can be operatively coupled to a control system (e.g., the control system 56 described above) that is configured to operate the drive system 74 rotate the feed rollers 64 in the desired manner.

In the illustrated embodiment, the drive system 74 includes a single motor 76 coupled to one of the feed rollers 64, and a transmission 78 operatively coupled to the two feed rollers 64 such that rotation of motorized feed roller 64 causes rotation of the other feed roller 64 at the same surface-linear speed but in an opposite direction. The motor 76 is an electric motor with variable speed such that the speed of its associated feed rollers 64 can be adjusted as desired. Moreover, the motor 76 is operatively coupled to the controller 60 of the control system 56 described above.

Preferably, the controller 60 is configured to operate the motor 76 of the drive system 74 so as to rotate the feed rollers 64 such that the ratio between the speed of the web 14 exiting the feed nip 70 and the speed of the web 14 exiting the first nip $N_1$ is equal to the take-up ratio of the first nip $N_1$. In this manner, the feed rollers 64 can feed the web 14 at the exact speed needed at the entrance of the first nip $N_1$, so that the web 14 has a mean tension of zero on entrance into the first nip $N_1$. However, in some examples, the ratio between the speed of the web 14 exiting the feed nip 70 and the speed of the web 14 exiting the first nip $N_1$ may be slightly less than the take-up ratio of the first nip $N_1$, in order to produce some finite, non-zero tension in the web 14 on entrance that prevents slacking of the web 14 on entry into the first nip $N_1$.

It is to be appreciated that the drive system 74 may have alternative configurations in other examples. For instance, in some examples, the transmission 78 may be absent and the other feed roller 64 will simply rotate with motorized feed roller 64 due to frictional engagement with the web 14 being fed through the feed rollers 64. Still in other examples, each feed roller 64 may be individually driven by a separate motor.

Indeed, the corrugating apparatus 10 can include a variety of different structures for feeding the web 14 to the first nip $N_1$ defined between the first and second corrugating rollers 12*a*, 12*b* at a desired speed. For instance, the '621 patent noted above discloses a corrugating pretensioning mechanism that can be incorporated into the present application to feed the web 14 to the first nip $N_1$ of the first and second corrugating rollers 12*a*, 12*b* at a desired speed and with a slight tension in the web 14. Moreover, in some examples the web 14 may simply be drawn from a source by the first and second corrugating rollers 12*a*, 12*b*, without any intermediary feeding mechanism.

As the web 14 traverses through the first nip $N_1$ of the corrugating apparatus 10, the tension of the web 14, as well as transverse compressive stresses (normal to the machine direction), will oscillate in magnitude as successive flutes are formed in the web 14 due to the relative up-and-down motion of the corrugating teeth 26*a*, 26*b* of the first and second corrugating rolls 12*a*, 12*b*, and due to roll and draw variations in the web 14 through the first nip $N_1$ as it is being corrugated. The oscillatory nature of web tension between corrugating rollers is well documented (see e.g., Clyde H. Sprague, Development of a Cold Corrugating Process Final Report, The Institute of Paper Chemistry, Appleton, Wash., Section 2, p. 45, 1985), and can often destroy a web.

Accordingly, as discussed further below, the corrugating apparatus 10 can include a capacitive feed apparatus upstream of the first nip $N_1$ that can adjust the web travel pathway 16 in phase with tension oscillations that result from the web 14 traversing the first nip $N_1$, in order to compensate for such oscillatory tension variance.

Figure 5:
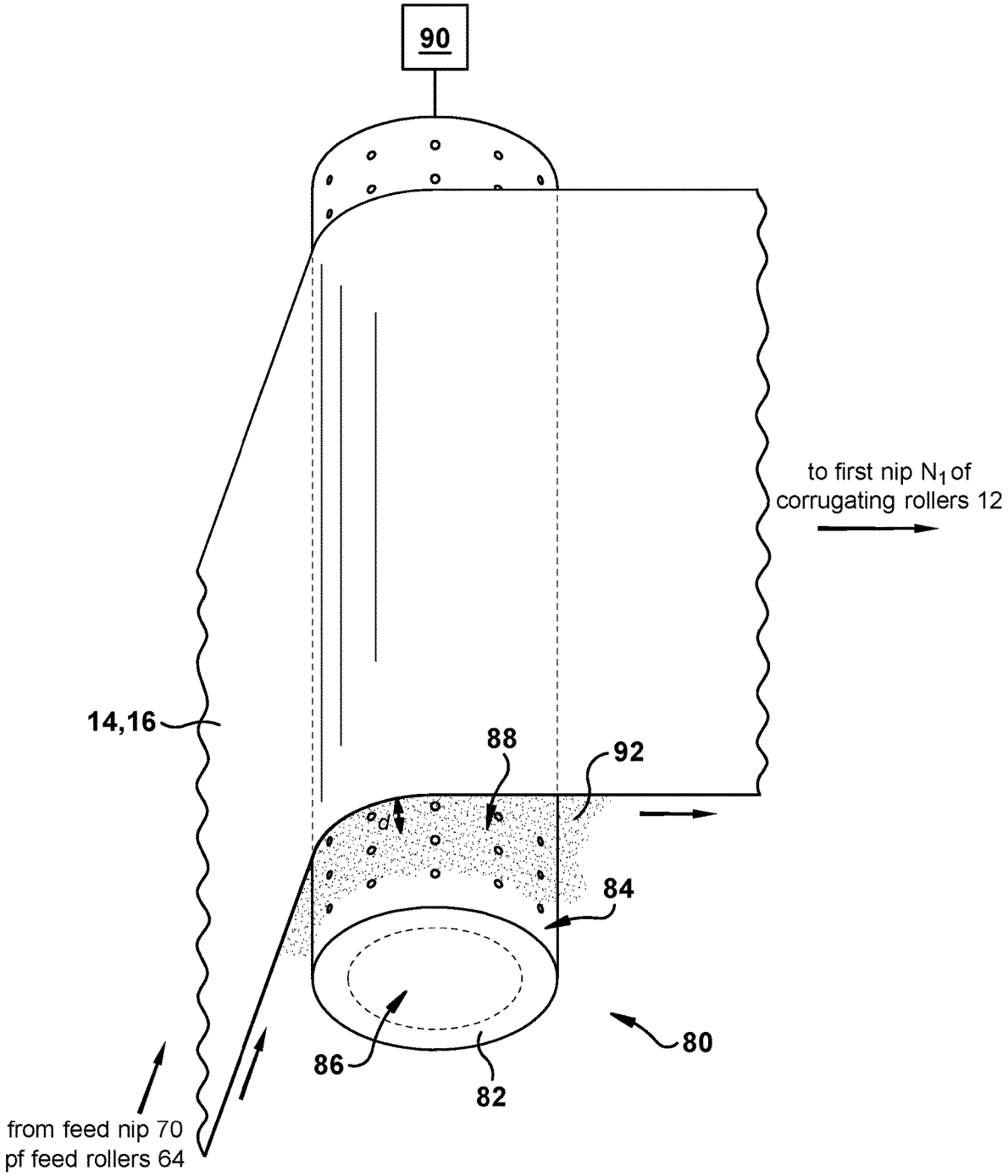
FIG. 5 is an enlarged view of an example capacitive feed apparatus of the corrugating apparatus.

For example, as shown in FIGS. 1 and 5, the corrugating apparatus 10 can include a capacitive feed apparatus 80 comprising a fixed body 82 having an arcuate surface 84. The fixed body 82 is fixed at a location downstream from the feed rollers 64 discussed above and upstream of the first corrugating nip $N_1$ such that the web travel pathway 16 extends from the feed nip 70 of the feed rollers 64, around at least a portion of the arcuate surface 84 of the fixed body 82, and then through the first nip $N_1$ of the first and second corrugating rollers 12*a*, 12*b*.

As shown in FIG. 5, the fixed body 82 of the capacitive feed apparatus 80 is a cylindrical body, wherein the arcuate surface 84 of the fixed body 82 corresponds to an outer, cylindrical surface of the fixed body 82. The fixed body 82 defines a chamber 86 within, and a plurality of apertures 88 that extend through the arcuate surface 84 of the fixed body 82 and provide fluid communication between the chamber 86 and an exterior of the fixed body 82.

The capacitive feed apparatus 80 further includes a pressurized air source 90 (e.g., air compressor) that is fluidly coupled to the chamber 86 within the fixed body 82 and is operable to deliver air into the chamber 86 and emit the air through the apertures 88 of the fixed body 82 so as to provide a cushion of air 92 that supports the web 14 at a variable distance d (shown in FIG. 5) from the arcuate surface 84. In particular, as tension is applied to the web 14, the web 14 will be drawn against the cushion of air 92 and thereby supported by the cushion of air 92 at the distance d.

The air source 90 and fixed body 82 can be designed such that air is emitted through the apertures 88 at a substantially constant volumetric flow rate that is sufficient to support the web 14 at maximum tension. For example, the total area of the apertures 88 can be designed such that the apertures 88 are the major restriction to flow through the apertures 88, regardless of the presence of the web 14 and the force it exerts on the cushion of air 92. In this manner, the pressure within the chamber 86 and the volumetric flow rate through the apertures 88 will be substantially constant.

As tension demand in the web 14 increases at the first nip $N_1$, the capacitive feed apparatus 80 is designed to instantaneously accelerate the feed of the web 14 into the first nip $N_1$ to accommodate and effectively null the increased tension demand. More specifically, as tension demand in the web 14 increases at the first nip $N_1$, the web 14 will be drawn against the air cushion 92 at a greater force and the distance d between the web/web travel pathway 14, 16 and arcuate surface 84 will decrease until the pressure of the air cushion 92 increases to a point such that the constant volumetric flow of air through the apertures 88 is sufficient to support the web 14. As a result, the overall length of the web travel pathway 16 between the feed nip 70 of the feed rollers 64 and the first nip $N_1$ of the first and second corrugating rollers 12*a*, 12*b* will decrease, causing the web 14 to accelerate into first nip $N_1$. The web 14 will briefly travel at an accelerated speed into the first nip $N_1$ until the tension demand is nulled, thereby causing the distance d between the web/web travel pathway 14, 16 and arcuate surface 84 to increase back to its original state.

Conversely, as tension demand in the web 14 decreases at the first nip $N_1$, the capacitive feed apparatus 80 is designed to instantaneously decelerate the feed of the web 14 into the first nip $N_1$ to accommodate and effectively null the decreased tension demand. More specifically, as tension demand in the web 14 decreases at the first nip $N_1$, the web 14 will be drawn against the air cushion 92 with lesser force and the distance d between the web/web travel pathway 14, 16 and arcuate surface 84 will increase until the pressure of the air cushion 92 decreases to a point such that the constant volumetric flow of air through the apertures 88 yields a pressure in equilibrium with the tension demand (i.e. the force with which the web presses toward the surface 84) of the web 14. As a result, the overall length of the web travel pathway 16 between the feed nip 70 of the feed rollers 64 and the first nip $N_1$ of the first and second corrugating rollers 12*a*, 12*b* will increase, causing entry of the web 14 into the first nip $N_1$ to decelerate. The web 14 will briefly travel at a decelerated speed until regular tension demand in the web 14 is restored, thereby causing the distance d between the web/web travel pathway 14, 16 and arcuate surface 84 to decrease back to its original state.

Accordingly, the capacitive feed apparatus 80 can passively react to and null oscillatory tension variance in the web 14 at the first nip $N_1$ by dynamically adjusting the length of the web travel pathway 16 between the feed nip 70 of the feed rollers 64 and the first nip $N_1$ via real-time, instantaneous and minute path-length adjustments made on-demand based on downstream oscillations in web tension within the first nip $N_1$. Put another way, the capacitive feed apparatus 80 will act a web capacitor that can store and discharge minute segments of effective web length along the pathway 16 as needed to null oscillatory tension variance in the web 14 at the first nip $N_1$.

The capacitive feed apparatus 80 in the illustrated embodiment is merely exemplary and may have alternative configurations in other embodiments that similarly adjust the web travel pathway 16 in phase with tension oscillations to compensate for oscillatory tension variance. For instance, the aforementioned '621 patent discloses a zero-contact roll having a stationary roller that is similarly configured to compensate for oscillatory tension variance and may be incorporated into the present application. Another alternative capacitive feed apparatus 102 is illustrated in FIG. 6 of the present drawings, and is discussed below in further detail.

Figure 6:
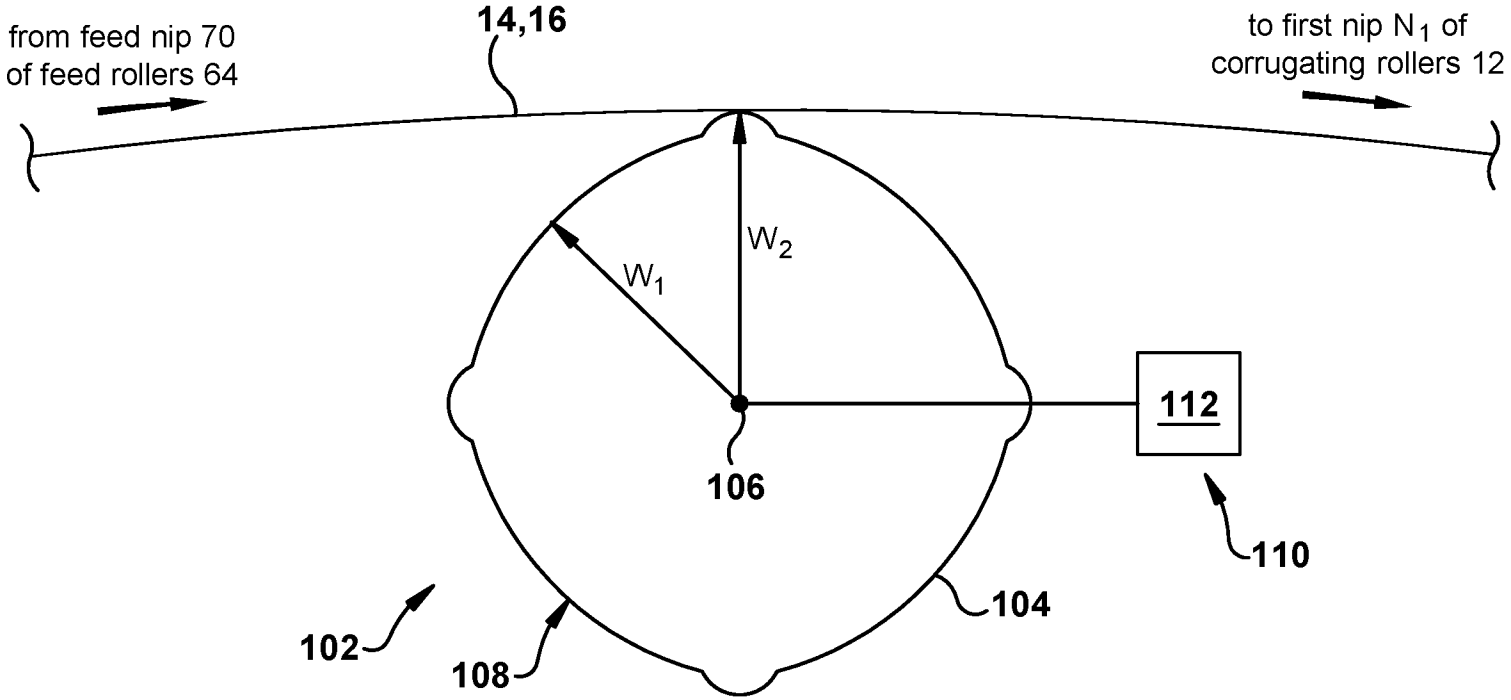
FIG. 6 is an enlarged view of another example capacitive feed apparatus of the corrugating apparatus.

As shown in FIG. 6, the capacitive feed apparatus 102 of this embodiment includes a cam roller 104 that is rotatable about a cam axis 106 and has an outer surface 108 that extends about the cam axis 106. The cam roller 104 is provided at a location downstream from the feed rollers 64 discussed above and upstream of the first nip $N_1$ along the web travel pathway 16 similarly as described above, so that the traveling web will engages a portion of the cam roller's outer surface 108 as it travels. As tension is applied to the web 14, the web 14 will be drawn against and supported by the outer surface 108.

The cam roller's outer surface 108 is designed such that a radial distance between the cam axis 106 and the outer surface 108 periodically increases and decreases about the cam axis 106 between a first radial distance $w_1$ and a second radial distance $w_2$ larger than the first radial distance $w_1$. Accordingly, as the cam roller 104 is rotated about the cam axis 106 with the web 14 drawn against the cam roller 104, the distance between the web/web travel pathway 14, 16 and the cam axis 106 will periodically increase and decrease, thereby causing the overall length of the web travel pathway 16 between the feed nip 70 of the feed rollers 64 and the first nip $N_1$ of the first and second corrugating rollers 12*a*, 12*b* to periodically increase and decrease.

In this manner, using a cam roller 104 whose alternating radii $w_1$ and $w_2$ have been tuned to correspond to the alternating tension demand (i.e. varying take-up ratio) through the first nip $N_1$ as the web 14 is drawn by successive corrugating teeth 26*a*, 26*b* therein, the cam roller 104 can be rotated at a fixed ratio relative to the rotational speed of the first corrugating roller 12*a* such that the periodic deflection of the web/web travel pathway 14, 16 from the cam axis 106 is in phase with the oscillatory tension variance of the first nip $N_1$.

More specifically, the cam roller 104 can be rotated such that at peak tension demands, the web 14 will engage a segment of the cam roller's outer surface 108 having its smallest radial distance $w_1$. As a result, the web/web travel pathway 14, 16 will be closest to the cam axis 106 and the overall length of the web travel pathway 16 between the feed nip 70 and the first nip $N_1$ will be shortened. The web 14 will briefly travel at an accelerated speed into the first nip $N_1$, until further rotation of the cam roller 104 causes the web/web travel pathway 14, 16 to deflect away from the cam axis 106 and lengthen the web travel pathway 16 between the feed nip 70 and the first nip $N_1$. Preferably, the magnitude of the smallest radial distance $w_1$ is set so that the corresponding acceleration of the web 14 caused by engagement with the cam roller's outer surface 108 at its smallest radial distance $w_1$ will effectively null the peak tension demand.

Meanwhile, at peak tension drops, the web 14 will engage a segment of the cam roller's outer surface 108 having its largest radial distance $w_2$. As a result, the web/web travel pathway 14, 16 will be farthest from the cam axis 106 and the overall length of the web travel pathway 16 between the feed nip 70 and the first nip $N_1$ will be lengthened. The web 14 will briefly travel at a decelerated speed into the first nip $N_1$, until further rotation of the cam roller 104 causes the web/web travel pathway 14, 16 to be drawn back towards the cam axis 106 and shorten the web travel pathway 16 between the feed nip 70 and the first nip $N_1$. Preferably, the magnitude of the largest radial distance $w_2$ is set so that the corresponding deceleration of the web 14 caused by engagement with the cam roller's outer surface 108 at its largest radial distance $w_2$ will effectively null the peak tension drop.

The fixed ratio in which the cam roller 104 is rotated relative to the first corrugating roller 12*a* will depend on, for example, the number of periodic changes in radial distance w about the circumference of the cam roller 104 versus the number of corrugating teeth 26*a* about the circumference of the first corrugating roller 12*a*. Moreover, it is to be appreciated that the cam roller 104 may be similarly rotated at a fixed ratio relative to the second corrugating roller 12*b* such that the periodic deflection of the web/web travel pathway 14, 16 from the cam axis 106 is in phase with the oscillatory tension variance of the first nip $N_1$. Indeed, because the first and second corrugating rollers 12*a*, 12*b* are rotated in synchronization as described above, rotating the cam roller 104 at a fixed ratio relative to one of the first and second corrugating rollers 12*a*, 12*b* will consequently rotate the cam roller 104 at a fixed ratio relative to the other of the first and second corrugating rollers 12*a*, 12*b*.

To rotate the cam roller 104 in the manner described above, the cam roller 104 can be coupled to one or both of the first and second corrugating rollers 12*a*, 12*b* via a transmission such that rotation of the first corrugating roller 12*a* and/or second corrugating roller 12*b* causes the cam roller 104 to correspondingly rotate according to the proper fixed ratio. In other examples, the corrugating apparatus 10 can include a drive system 110 (see e.g., FIG. 6) having a motor 112 that is coupled to the cam roller 104 and operable to rotate the cam roller 104 accordingly. The motor 112 can be an electric motor with variable speed such that the speed of the cam roller 104 can be adjusted as desired. Moreover, the motor 112 can be operatively coupled to the controller 60 described above such that the controller 60 can operate the motor 112 to rotate the cam roller 104 in the manner described above.

Accordingly, the capacitive feed apparatus 102 can null oscillatory tension variance in the web 14 at the first nip $N_1$ by adjusting the length of the web travel pathway 16 between the feed nip 70 of the feed rollers 64 and the first nip $N_1$, as described above.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims and their equivalents.

What is claimed is:

1. An apparatus for producing a corrugated product, comprising:

a roller train comprising:

a first corrugating roller having a first set of corrugating teeth, a second corrugating roller having a second set of corrugating teeth, a third corrugating roller having a third set of corrugating teeth, and a fourth corrugating roller having a fourth set of corrugating teeth;

a first nip defined between said first and second corrugating rollers opposing one another;

a second nip defined between said second and third corrugating rollers opposing one another; and a third nip defined between said third and fourth corrugating rollers opposing one another;

each tooth in each of said first, second, third and fourth sets of teeth comprising a distal face, a leading flank and a trailing flank, the distal faces of each of said first and second sets of teeth being rounded, the distal faces of each of said third and fourth sets of teeth being flattened relative to the distal faces of each of said first and second sets of teeth.

2. The apparatus of claim 1, each tooth of the first and second sets of teeth having radiused edges between the distal face and the respective leading and trailing flanks thereof; and each tooth of the third and fourth sets of teeth having reduced-radius edges between the distal face and the respective leading and trailing flanks thereof, said reduced-radius edges having radii of curvature smaller than the edges of the teeth of the first and second sets of teeth.

3. The apparatus of claim 2, the radii of curvature of said edges of said third and fourth sets of teeth being not more than 0.5 times the radii of curvature of said edges of either of said first and second sets of teeth.

4. The apparatus of claim 1, each said leading and trailing flank of each tooth in all of said first, second, third and fourth sets of teeth having a planar surface that extends substantially parallel to a diametral plane of the tooth.

5. The apparatus of claim 1, the distal faces of the teeth of the fourth set of teeth having substantially the same width and circumferential spacing as the distal faces of the teeth of the third set of teeth.

6. The apparatus of claim 1, each tooth in all of said first, second, third and fourth sets of teeth comprising an outer portion that extends radially outward from an imaginary pitch circle of the tooth, the outer portions of the teeth of the fourth set of teeth being substantially the same in shape and circumferential spacing as the outer portions of the teeth of the third set of teeth.

7. The apparatus of claim 1, the teeth of the fourth set of teeth having substantially the same shape and circumferential spacing as the teeth of the third set of teeth.

8. The apparatus of claim 1, at least one of the second and third corrugating rollers having a diameter that is less than diameters of all the remaining corrugating roller(s).

9. The apparatus of claim 8, the diameter of the third corrugating roller being less than the diameters of each of the first, second, and fourth corrugating rollers.

10. The apparatus of claim 1, further comprising:

a roller drive system coupled to two of said corrugating rollers that define one of said nips therebetween, the roller drive system being operable to rotate said two corrugating rollers; and a control system coupled to and configured to operate the roller drive system to ensure that the opposing teeth of said two corrugating rollers do not engage each other in said nip on rotation of said two rollers.

11. The apparatus of claim 10, said roller drive system being coupled to at least three of said corrugating rollers.

12. The apparatus of claim 1, further comprising a mechanical transmission linking two of said corrugating rollers that define one of said nips therebetween, said transmission being adapted to fix relative rotational speeds and positions of said two corrugating rollers so as to ensure that the opposing teeth thereof do not engage each other in the nip defined therebetween.

13. The apparatus of claim 10, wherein the control system includes a controller and first and second sensors associated respectively with each of said two corrugating rollers and adapted to provide feedback to the controller concerning an operating parameter of the associated corrugating roller.

14. The apparatus of claim 10, the roller drive system comprising:

a first motor operable to rotate the first corrugating roller independently, a second motor operable to rotate the second corrugating roller independently, a third motor operable to rotate the third corrugating roller independently, and a fourth motor operable to rotate the fourth corrugating roller independently; and a first rotary encoder configured to provide feedback to the controller concerning a rotary position of the first corrugating roller, a second rotary encoder configured to provide feedback to the controller concerning a rotary position of the second corrugating roller, a third rotary encoder configured to provide feedback to the controller concerning a rotary position of the third corrugating roller, and a fourth rotary encoder configured to provide feedback to the controller concerning a rotary position of the fourth corrugating roller.

15. The apparatus of claim 1, further comprising a pair of feed rollers defining a feed nip therebetween and located upstream of said first nip along a web travel pathway, said pair of feed rollers being rotatable to feed a web through said feed nip on its way to said first nip along the web travel pathway.

16. The apparatus of claim 15, further comprising a feed drive system operable to rotate the pair of feed rollers, and a controller configured to operate the feed drive system to rotate said feed rollers such that a ratio between a speed of the web exiting said first nip and a speed of the web exiting said feed nip is equal to or less than a take-up ratio for said web through said first nip.

17. The apparatus of claim 15, further comprising a capacitive feed apparatus located upstream of the first nip and downstream of the feed nip along the web travel pathway and adapted to dynamically adjust a path length of said pathway therebetween in phase with tension oscillations in said web that result from the web traversing said first nip.

18. The apparatus of claim 17, said capacitive feed apparatus comprising:

a fixed body having an arcuate surface and a chamber therein, a plurality of apertures extending through the arcuate surface and providing provide fluid communication between the chamber and an exterior of the fixed body; and a fluid source that is fluidly coupled to the chamber and operable to deliver fluid therein and through said apertures so as to provide a cushion of said fluid adapted to support the web at a variable distance from the arcuate surface as it travels thereover along said web travel pathway.

19. The apparatus of claim 17, the capacitive feed apparatus comprising a cam roller rotatable about a cam axis and having a variable radius such that a radial distance between the cam axis and the outer surface periodically increases and decreases about said cam axis.

20. The apparatus of claim 19, further comprising:

a cam drive system operable to rotate the cam roller about the cam axis; and a controller configured to operate the cam drive system to rotate the cam roller at a speed having a fixed ratio relative to a rotational speed of either or both the first and/or the second corrugating rollers in order to achieve said dynamic path-length adjustment.

21. The apparatus of claim 1, each of the opposing rollers defining the respective nips therebetween being arranged such that the opposing teeth thereof in the respective nip do not contact one another and do not contact opposing valleys on the opposing one of said rollers as they rotate.

22. The apparatus of claim 1, said first, second and third nips defining respective pathways therethrough yielding a substantially constant take-up ratio, such that substantially no additional gathering of web length for a web traveling through said roller train will occur in said train after exiting said first nip.

23. A method of introducing trapezoidal corrugations to a traveling web, comprising:

feeding the web through a first nip defined between first and second corrugating rollers having respective first and second sets of teeth that oppose one another in said first nip, said web following a first path through said first nip tangent to respective edges of the opposing teeth therein;

thereafter feeding said web through a second nip defined between said second corrugating roller and a third corrugating roller, the third corrugating roller having a third set of teeth that opposes said second set of teeth in said second nip, said web following a second path through said second nip tangent to respective edges of the second set of teeth and discretely folding over respective edges of said third set of teeth therein; and thereafter feeding said web through a third nip defined between said third corrugating roller and a fourth corrugating roller, the fourth corrugating roller having a fourth set of teeth that opposes said third set of teeth in said third nip, said web following a third path through said third nip discretely folding over respective edges of the third set of teeth and fourth set of teeth therein, said web emerging from said third nip possessing a substantially fully trapezoidal corrugated conformation.

24. The method of claim 23, wherein a predominant proportion of a said web traversing said first nip does not contact the opposing first and second sets of teeth therein, a predominant proportion of said web traversing said second nip does not contact the opposing second and third sets of teeth therein, and a predominant proportion of said web traversing said third nip does not contact the opposing third and fourth sets of teeth therein.

25. The method of claim 23, the respective edges of each tooth of said first and second sets of teeth being radiused edges, the respective edges of each tooth of said third and fourth sets of teeth being sharp edges.

26. The method of claim 23, said first and second sets of teeth having rounded distal faces and said third and fourth sets of teeth having flattened distal faces, wherein said web is drawn against the opposing rounded distal faces of the first and second sets of teeth in said first nip, against the opposing rounded and flattened distal faces of the second and third sets of teeth in said second nip, and against the opposing flattened distal faces of the third and fourth sets of teeth in said third nip.

27. The method of claim 26, said web not contacting flanks of any of the teeth in any of said first, second, third and fourth sets of teeth as it traverses each of said first, second and third nips.

28. The method of claim 23, said web entering said first nip essentially flat and emerging from said first nip possessing a sinus corrugated conformation according to a take-up ratio, said take-up ratio being substantially constant through said second and third nips such that there is substantially no additional gathering of web length through said roller train after exiting said first nip.

* * * * *